US009151481B2

(12) United States Patent
Dellian et al.

(10) Patent No.: US 9,151,481 B2
(45) Date of Patent: Oct. 6, 2015

(54) END PIECE FOR A RETROFIT FLUORESCENT LAMP AND RETROFIT FLUORESCENT LAMP

(75) Inventors: Harald Dellian, Edling (DE); Nimchung Ku, Shenzhen (CN); Qing Liu, Shenzhen (CN); Stefan Otzen, München (DE)

(73) Assignee: OSRAM GmbH, Munich (DE)

( * ) Notice: Subject to any disclaimer, the term of this patent is extended or adjusted under 35 U.S.C. 154(b) by 121 days.

(21) Appl. No.: 13/516,253

(22) PCT Filed: Dec. 16, 2010

(86) PCT No.: PCT/EP2010/069918

§ 371 (c)(1),
(2), (4) Date: Aug. 1, 2012

(87) PCT Pub. No.: WO2011/073327

PCT Pub. Date: Jun. 23, 2011

(65) Prior Publication Data

US 2012/0306342 A1 Dec. 6, 2012

(30) Foreign Application Priority Data

Dec. 18, 2009 (DE) ..... 10 2009 054 994

(51) Int. Cl.

| | |
|---|---|
| ***H01J 1/88*** | (2006.01) |
| ***H01J 7/24*** | (2006.01) |
| ***F21V 25/04*** | (2006.01) |
| ***F21K 99/00*** | (2010.01) |
| ***F21V 17/10*** | (2006.01) |
| ***F21V 17/16*** | (2006.01) |
| ***F21V 29/00*** | (2015.01) |
| ***F21V 29/507*** | (2015.01) |
| *F21Y 101/02* | (2006.01) |
| *F21Y 103/00* | (2006.01) |

(Continued)

(52) U.S. Cl.

CPC . *F21V 25/04* (2013.01); *F21K 9/17* (2013.01); *F21V 17/101* (2013.01); *F21V 17/164* (2013.01); *F21V 29/20* (2013.01); *F21V 29/507* (2015.01); *F21V 23/003* (2013.01); *F21Y 2101/02* (2013.01); *F21Y 2103/003* (2013.01); *F21Y 2113/005* (2013.01)

(58) Field of Classification Search

CPC ..... F21V 7/00; G02B 27/1006
See application file for complete search history.

(56) References Cited

U.S. PATENT DOCUMENTS

| | | | | |
|---|---|---|---|---|
| 4,753,603 A | | 6/1988 | Hafstad | |
| 5,904,415 A | * | 5/1999 | Robertson et al. | 362/260 |
| 6,162,096 A | | 12/2000 | Klaus | |

(Continued)

FOREIGN PATENT DOCUMENTS

| | | | |
|---|---|---|---|
| DE | 202004011169 | U1 | 2/2005 |
| DE | 102007030186 | B4 | 4/2009 |

(Continued)

OTHER PUBLICATIONS

For DE 202004011169U1 an English abstract is provided.

(Continued)

*Primary Examiner* — Elmito Breval

(57) ABSTRACT

An end piece for a retrofit fluorescent lamp may include a housing section open on a first end face and a cover that can close off the first end face, wherein the housing section and the cover can be non-detachably interlocked.

15 Claims, 4 Drawing Sheets

(51) Int. Cl.
*F21Y 113/00* (2006.01)
*F21V 23/00* (2015.01)

(56) References Cited

U.S. PATENT DOCUMENTS

| | | | | |
|---|---|---|---|---|
| 6,582,102 | B2 * | 6/2003 | Lin | 362/304 |
| 7,097,508 | B1 * | 8/2006 | Yang | 439/617 |
| 8,206,167 | B2 | 6/2012 | Reuter et al. | |
| 8,232,724 | B2 * | 7/2012 | Mostoller et al. | 313/512 |
| 2008/0031005 | A1 * | 2/2008 | Liao | 362/581 |
| 2009/0159919 | A1 * | 6/2009 | Simon et al. | 257/99 |
| 2009/0201679 | A1 | 8/2009 | Konaka | |
| 2010/0201239 | A1 * | 8/2010 | Mostoller et al. | 313/1 |
| 2010/0201284 | A1 | 8/2010 | Kraus | |
| 2010/0277918 | A1 * | 11/2010 | Chen et al. | 362/249.02 |
| 2010/0304079 | A1 * | 12/2010 | Yang et al. | 428/99 |

FOREIGN PATENT DOCUMENTS

| | | | |
|---|---|---|---|
| DE | 102007045540 | A1 | 4/2009 |
| DE | 112007002136 | T5 | 7/2009 |
| EP | 621443 | B1 | 7/1997 |
| EP | 2194315 | A1 | 6/2010 |
| WO | 8808103 | A1 | 10/1988 |
| WO | 2008119420 | A1 | 10/2008 |
| WO | 2009000536 | A1 | 12/2008 |
| WO | 2009121898 | A1 | 10/2009 |
| WO | 2009138108 | A1 | 11/2009 |
| WO | 2010050685 | A2 | 5/2010 |

OTHER PUBLICATIONS

For EP 621443B1 an English abstract is provided.

* cited by examiner

END PIECE FOR A RETROFIT FLUORESCENT LAMP AND RETROFIT FLUORESCENT LAMP

RELATED APPLICATIONS

The present application is a national stage entry according to 35 U.S.C. §371 of PCT application No.: PCT/EP2010/069918 filed on Dec. 16, 2010, which claims priority from German application No.: 10 2009 054 994.3 filed on Dec. 18, 2009.

TECHNICAL FIELD

Various embodiments relate to an end piece for a retrofit fluorescent lamp, e.g. an LED retrofit fluorescent lamp.

BACKGROUND

LED retrofit fluorescent lamps are designed to replace conventional fluorescent lamps and use light-emitting diodes (LEDs) as light sources. The LED retrofit fluorescent lamp can be inserted in holders provided for the conventional fluorescent lamps and must have approximately the same shape and light output characteristic as the conventional fluorescent lamps. The LED retrofit fluorescent lamp therefore also has, along a longitudinal axis, a shape which typically does not essentially extend beyond the known cylindrical outside contour of the conventional fluorescent lamp. The LED retrofit fluorescent lamp requires a driver to operate the light-emitting diodes. In some LED retrofit fluorescent lamps, the driver is accommodated in an end piece which then also serves as a driver housing. Hitherto, the end piece has had a housing section open to one side and a cover closing off the housing section. The housing section and the cover are fastened together by metal screws, wherein the screws are covered by a plastic cap after being installed.

The disadvantage of the existing LED retrofit fluorescent lamps is that the screws can be undone using simple means and the cover can then be removed without difficulty. The driver electronics are then freely accessible, thus posing a shock hazard. Assembly is also relatively complex due to the need for a screwed connection and for mounting of the plastic caps.

SUMMARY

Various embodiments may at least reduce at least some of the disadvantages of the prior art and may e.g. provide an easily assembled and difficult-to-open driver housing for a retrofit fluorescent lamp.

Various embodiments provide an end piece for a retrofit fluorescent lamp, wherein the end piece has a housing section open on a first end face and a cover which can close off the first end face, the housing section and cover being non-detachably interlockable.

This snap-lock connection is more difficult to open than the screwed connection used hitherto, particularly as it is not intended or designed for easy release. Moreover, the housing section and the cover can be locked and therefore securely fastened merely by pushing them together. No additional elements are required.

"Non-detachable interlocking" may be understood in particular as a snap-locking arrangement which is not designed to be undone and which can only be released at the expense of considerable effort, possibly only using a tool, and/or of damage to the end piece.

On the second end face opposite the first end face, the end piece can be connected to the heat sink having the at least one light source, in particular light-emitting diode.

The at least one light source preferably includes at least one light-emitting diode. If a plurality of light-emitting diodes is present, these can emit in the same color or in different colors. A color can be monochromatic (e.g. red, green, blue, etc.) or multichromatic (e.g. white). The light produced by the at least one light-emitting diode can also be infrared light (IR-LED) or ultraviolet light (UV-LED). A plurality of light-emitting diodes can produce a mixed light, e.g. a white mixed light. The at least one light-emitting diode can contain at least one wavelength-converting phosphor (conversion LED). The at least one light-emitting diode can be present in the form of at least one individually packaged light-emitting diode or in the form at least one LED chip. A plurality of LED chips can be mounted on a common substrate ("submount"). The at least one light-emitting diode can be equipped with at least one separate and/or common optical system for beam guidance, e.g. at least one Fresnel lens, collimator, etc. Instead of or in addition to inorganic light-emitting diodes, e.g. based on InGaN or AlInGaP, organic LEDs (OLEDs, e.g. polymer OLEDs) can also generally be used. Diode lasers, for example, can also be used. Alternatively, the at least one light source can have e.g. at least one diode laser or another semiconductor light source.

In one embodiment, at least two projecting locking hooks are present on the first end face of the end piece and the cover has corresponding locking recesses, wherein the locking recesses are not freely accessible. As a result, the attachment mechanism as such is not only more difficult to release, but is also less readily accessibly.

In another embodiment, the end piece has a least two, preferably at least three, projecting locking hooks, in particular pairs of locking hooks, on the end face. Pairs of locking hooks are even more difficult to release than single locking hooks and provide the same mechanical stability in both directions in the event of rotational movement. The provision of a plurality of locking hooks makes detachment even more difficult, as these have to be released simultaneously in order to separate the cover and housing section, which becomes increasingly difficult the more connections there are to be released.

In another embodiment, the locking recesses of the cover are concealed by a ring, thereby providing a simply implementable covering that is difficult to circumvent.

In a further embodiment, at least one projecting coding element is present on the first end face of the end piece and the cover has at least one corresponding coding element recess. This ensures a desired relative angular position of the cover and housing section, particularly about the longitudinal axis of the end piece or of the retrofit fluorescent lamp.

In another embodiment, the coding element is implemented in the form of a triangle, in particular having a flattened apex. Said coding element is particularly easy to insert in the coding element recess and is self-aligning.

In another embodiment, the housing section has, on its second end face opposite the first end face, a plug pin or connecting pin for insertion into a heat sink, thereby providing a mechanically simple and secure connection of the housing section to the heat sink and also assisting effective heat transfer.

In another embodiment, the plug pin has an outside contour that is essentially circular segment shaped in the insertion direction, thereby enabling the housing section and the heat sink to be non-rotationally attached to one another. The plug pin can therefore be used like a coding element.

In yet another embodiment, the plug pin has at least one screw bushing running at right angles to the insertion direction, thus enabling the plug pin to be simply screwed to the heat sink. For this purpose the heat sink can have coincident screw holes particularly in the assembled state.

Various embodiments provide a retrofit fluorescent lamp, wherein the retrofit fluorescent lamp has an end piece as described above.

In a further development, the end piece houses a driver or, in other words, a driver is accommodated in the end piece, in particular essentially in the housing section.

In another further development, the retrofit fluorescent lamp has a hollow, elongated heat sink extending along a longitudinal axis of the retrofit fluorescent lamp, wherein a shape of the inside contour essentially corresponds to the shape of the outside contour of the plug pin.

In yet another further development, the heat sink has at least one screw hole which can be made to coincide with the screw bushing of the plug pin.

BRIEF DESCRIPTION OF THE DRAWINGS

In the following figures, the invention will be described schematically in greater detail with reference to an exemplary embodiment, wherein, for the sake of clarity, elements that are identical or produce the same effect may be provided with the same reference characters.

DETAILED DESCRIPTION

The following detailed description refers to the accompanying drawings that show, by way of illustration, specific details and embodiments in which the invention may be practiced.

Figure 1:
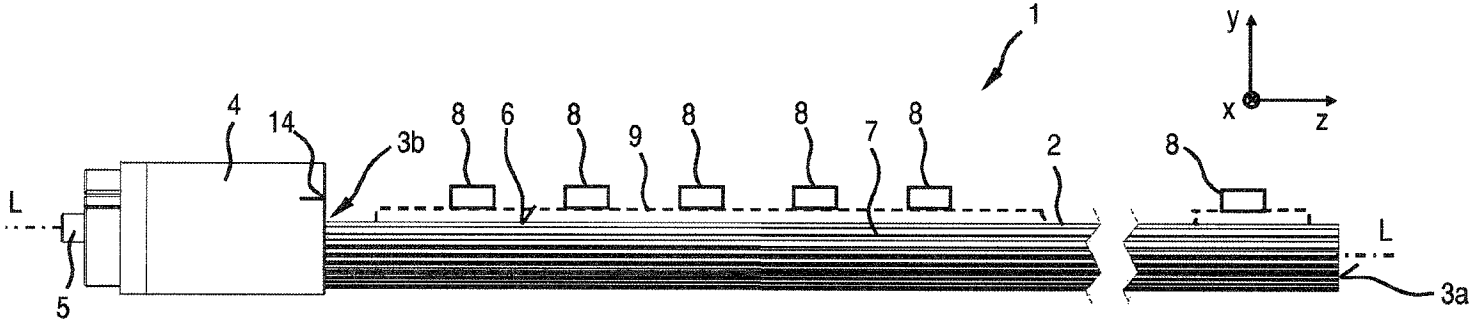
FIG. 1 shows a side view of parts of an LED retrofit fluorescent lamp according to the invention.
Figure 2:
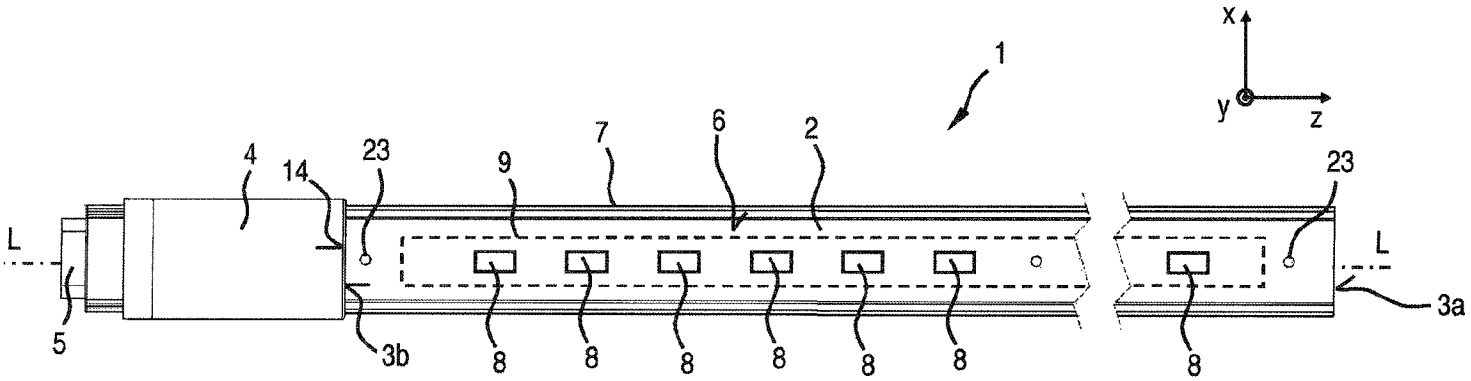
FIG. 2 shows a plan view of the LED retrofit fluorescent lamp from FIG. 1.

FIG. 1 shows a side view of parts of an LED retrofit fluorescent lamp 1 and FIG. 2 shows a plan view of the LED retrofit fluorescent lamp 1. The LED retrofit fluorescent lamp 1 has as a central element a heat sink 2 which is covered on both of its end faces 3*a*, 3*b* by an end piece in each case. The end piece provided for mounting on the end face 3*a* shown here on the right hand side (upper Fig.) is essentially used for mechanical mounting of the LED retrofit fluorescent lamp 1 in a conventional fluorescent lamp holder. Abutting the end face 3*b* shown here on the left hand side is an end piece 4 which is implemented as a driver housing. Said end piece 4 accommodates a driver (upper Fig.) which converts power supplied via an electrical connection 5 into a suitable current or voltage for operating light-emitting diodes 8.

The end piece 4 has an at least roughly cylindrical outside contour similar to an outside contour of a conventional fluorescent lamp. The heat sink 2 is a hollow body extending in the direction of a longitudinal axis L of the LED retrofit fluorescent lamp 1 and having a cross-sectional shape of an edge of a circular segment. An upper side 6 of the heat sink 2 is essentially flat, whereas an adjoining cylindrical surface region therebelow (in the direction contrary to the Y-axis) has a circular arc shaped cross-section. Said cylindrical surface region with a circular arc shaped cross-section is patterned on its surface to intensify a cooling effect and has here perpendicularly out-turned cooling ribs or fins 7. Light-emitting diodes 8 can be mounted on the flat, ribbon-like upper side 6 of the heat sink 2 and the light-emitting diodes 8 can be disposed, for example, equidistantly on a ribbon-like circuit board 9 (LED strip) indicated here by a dashed line. The ribbon-like circuit board 9 can be attached by its rear side to the upper side 6 of the heat sink 2 e.g. using double-sided adhesive tape. In a cavity of the heat sink 2 a plug can be accommodated which is connected to the circuit board 9 via electrical leads (upper Fig.).

Figure 3:
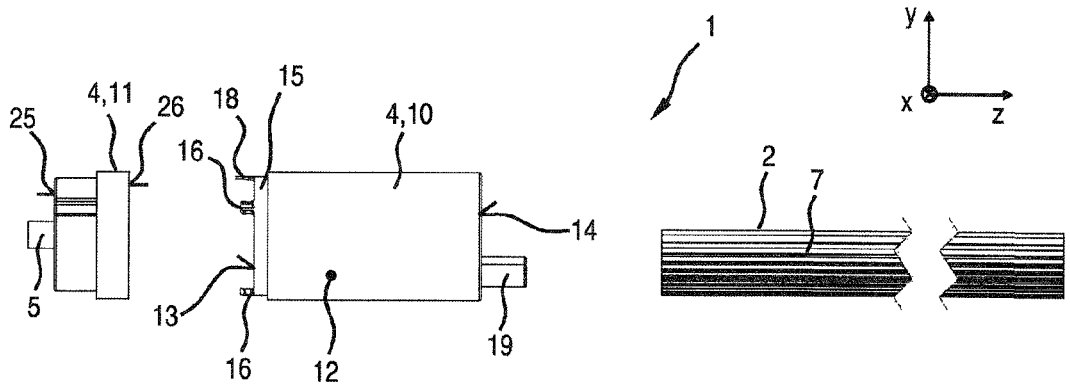
FIG. 3 shows an exploded side view of the parts of the LED retrofit fluorescent lamp.
Figure 4:
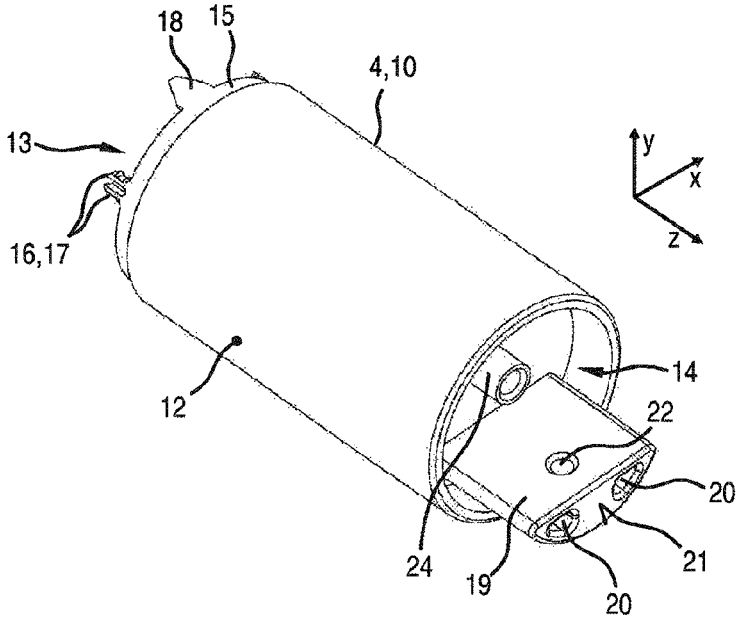
FIG. 4 shows an oblique view of a housing section of an inventive end piece of the LED retrofit fluorescent lamp.
Figure 5:
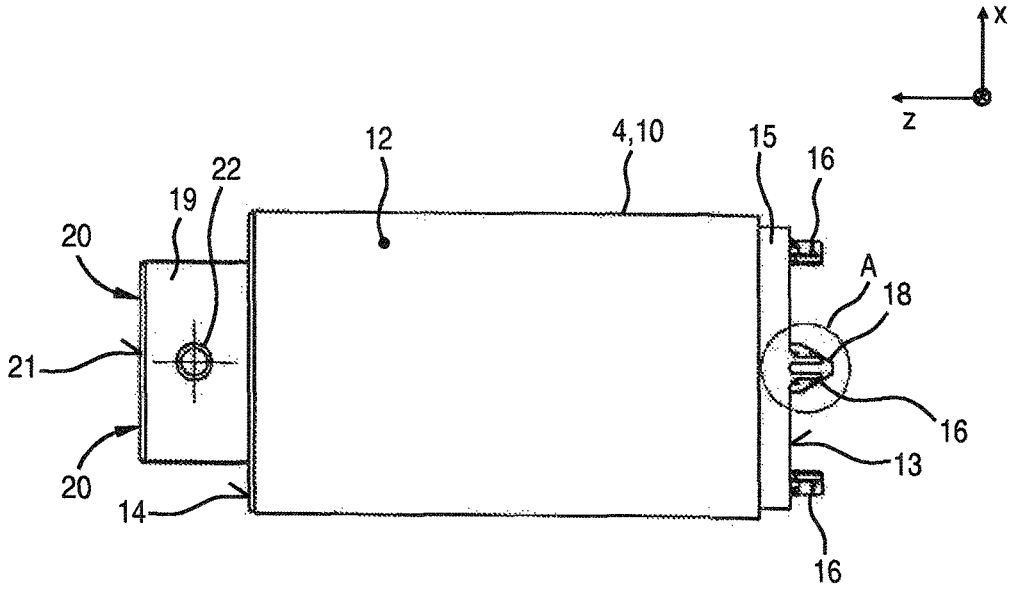
FIG. 5 shows the housing section from FIG. 4 viewed from below.
Figure 6:
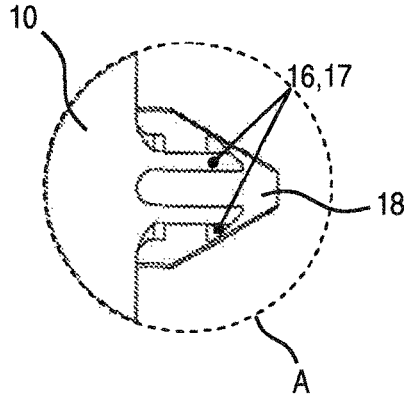
FIG. 6 shows an enlarged detail from FIG. 5.

FIG. 3 shows an exploded view of the LED retrofit fluorescent lamp 1 from FIG. 1, wherein the end piece 4 is now of two-part design including a housing section 10 and a cover 11 for the housing section 10. FIG. 4 shows an oblique view of the housing section 10. FIG. 5 show the housing section 10 viewed from below. The housing section 10 has a hollow-cylindrical basic body 12 which is open on a first end face 13 and is essentially or at least partially closed on a second end face 14. A driver, for example, can be inserted into the hollow-cylindrical basic body 12 through the first end face 13. The first end face 13 can be closed off by means of the cover 11. For this purpose the hollow-cylindrical basic body 12 has, in the region of its first end face 13, i.e. frontally, a circumferential mounting rim 15 onto which the cover 11 can be attached. Three pairs 16 of locking hooks 17 extend in the longitudinal direction from the hollow-cylindrical basic body 12 and therefore also from the mounting rim 15. The cover 11 has recesses corresponding to the pairs 16 of projecting locking hooks 17, so that when the cover 11 is placed on the housing section 10, these two parts are in mutual engagement and are thus snap-locked. To ensure a correct relative angular position of the housing section 10 and of the cover 11, a coding element 18 projects from the end face 13 of the housing section 10 parallel to the longitudinal axis L, wherein a matching coding element recess 33 (see FIG. 8 or FIG. 9) is present in the cover 11. By means of the snap-locking with the three pairs 16 of locking hooks 17, it becomes much more difficult to separate the housing section 10 from the cover 11 in the assembled and snap-locked position in comparison with undoing screws, thereby better preventing an electric shock hazard when the end piece 4 is opened. The end piece 4 is also now only of two-part design and can be assembled ready for operation by a simple attachment process.

Projecting from the second end face 14 as a longitudinal extension of the LED retrofit fluorescent lamp 1 is a connecting pin or plug pin 19 which is designed to be inserted into the cavity of the heat sink 2. For this purpose, an outside contour of the plug pin 19 is of essentially the same shape as the inside contour of the heat sink 2. The plug pin 19 has, on its free end face 21, two bushing-like openings 20 via which the driver circuit incorporated in the housing section 10 can be electrically connected to the light-emitting diodes 8 or rather to the circuit board 9 carrying the light-emitting diodes 8. The connecting pin or plug pin 19 additionally has a screw bushing 22 running perpendicularly from top to bottom which, when the end piece 4 or the housing section 10 is mounted, can be made to coincide with at least one screw hole 23 of the heat sink so that the heat sink 2 and the housing section 10 can be fastened together by means of a screw passed through the at least one screw hole 23 and the screw bushing 22. On the second end face 14 of the housing section 10 there is also a bushing or feed-through 24 for feeding though an attachment means or for feeding though electrical leads or for making contact with a plug.

Figure 7:
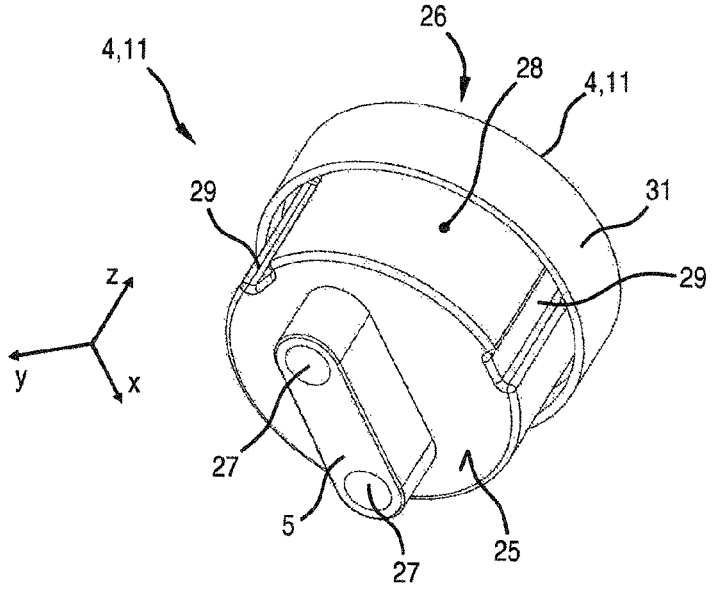
FIG. 7 shows an oblique view of a cover of the end piece according to the invention.
Figure 8:
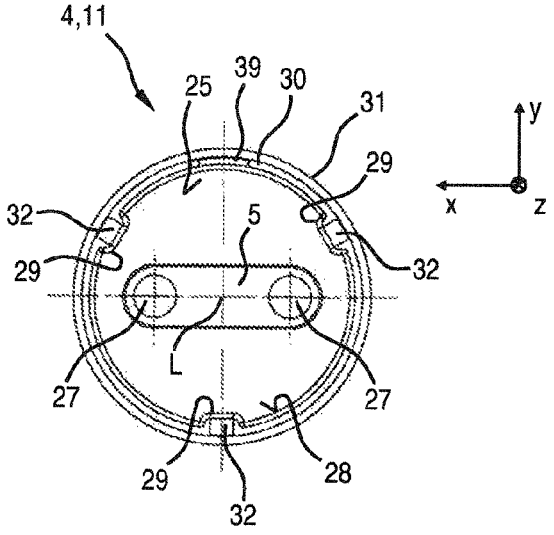
FIG. 8 shows a view onto an end face of the cover from FIG. 7.
Figure 9:
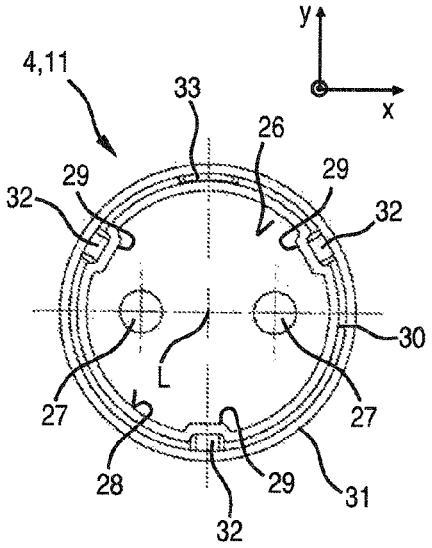
FIG. 9 shows a view onto another end face of the cover from FIG. 7.

FIG. 7 shows an oblique view of the cover 11 of the end piece 4, FIG. 8 shows a view onto an end face 25 of the cover 11, said end face having the electrical connection 5, and FIG. 9 shows a view onto the other end face 26 of the cover 11, which end face faces the housing section 10.

The electrical connection 5 has two through-going receptacles 27. Three straight indentations 29 or channels disposed in an angularly symmetrical manner with respect to the longitudinal axis L and extending parallel to the longitudinal axis L are provided on a sidewall 28. In the region of the end face 26, the sidewall 28 has a circumferential rim 30 on which is seated a circumferential ring 31. The rim 30 has locking recesses 32 at the indentations 29.

To mount the cover 11 on the housing section 10, the pairs 16 of locking hooks 17 are guided along the indentations 29 until the associated lugs are guided through the locking recesses 32 and the locking hooks 17 snap apart. Access to the locking hooks 17 and the associated locking recesses 32 is made extremely difficult and virtually prevented by the ring 31 covering them. The connection between the cover 11 and the housing section 10 may therefore be regarded as non-detachable.

Also present in the rim 30 is a coding element recess 33 for insertion of the coding element 18.

The present invention is self-evidently not limited to the exemplary embodiment shown.

For example, the locking hooks and locking recesses can also be disposed on the respective other component. The same applies to the coding element and coding recess.

In general, the retrofit fluorescent lamp is not limited to use with LEDs and can also include, for example, other semiconductor lighting elements such as laser diodes or even other kinds of miniature lamps, such as low-pressure lamps.

Also, the cover can constitute the other end face of the end piece and then e.g. incorporate the plug pin, while the housing section can incorporate the electrical connection to the holder. The cover can (particularly along the longitudinal axis of the retrofit lamp) be shorter than the housing section or of approximately the same length.

The type of retrofit fluorescent lamp is not limited and can be designed e.g. to replace a type T5, T8, T12, etc. fluorescent lamp of corresponding length and having a suitable base. As a result, the design of the electrical connection 5 in particular may vary from the embodiment shown.

While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes which come within the meaning and range of equivalency of the claims are therefore intended to be embraced.

LIST OF REFERENCE CHARACTERS

1 retrofit fluorescent lamp
2 heat sink
3*a* end face of heat sink
3*b* end face of heat sink
4 end piece
5 electrical connection
6 upper side of heat sink
7 cooling fin
8 light-emitting diode
9 circuit board
10 housing section of end piece
11 cover of end piece
12 basic body
13 first end face of end piece
14 second end face of end piece
15 mounting rim
16 pair of locking hooks
17 locking hooks
18 coding element
19 plug pin
20 opening
21 free end face of connecting pin
22 screw bushing
23 screw hole
24 bushing
25 end face of cover
26 end face of cover
27 receptacle
28 sidewall of cover
29 indentation
30 rim
31 circumferential ring
32 locking recess
33 coding element recess
L longitudinal axis

The invention claimed is:

1. An end piece for a retrofit fluorescent lamp, the end piece comprising:

a housing section open on a first end face and a cover that is configured to close off the first end face, wherein the housing section and the cover are configured to be non-detachably interlocked, wherein at least two projecting locking hooks are present on the first end face of the end piece and the cover has corresponding locking recesses.

2. The end piece as claimed in claim 1, wherein the locking recesses are not freely accessible.

3. The end piece as claimed in claim 1, wherein the end piece has at least two pairs of locking hooks projecting from the end face.

4. The end piece as claimed in claim 1, wherein the locking recesses are covered by a ring.

5. The end piece as claimed in claim 1, wherein at least one projecting coding element is present on the first end face of the end piece and the cover has at least one corresponding coding element recess.

6. The end piece as claimed in claim 5, wherein the coding element is implemented in the form of a triangle.

7. The end piece as claimed in claim 6, wherein the coding element is implemented in the form of a triangle with a flattened apex.

8. The end piece as claimed in claim 1, wherein the housing section has, on its second end face opposite the first end face, at least one plug pin for insertion in a heat sink.

9. The end piece as claimed in claim 8, wherein the plug pin has an essentially circular segment shaped outside contour in the insertion direction.

10. The end piece as claimed in claim 8, wherein the plug pin has at least one screw bushing running at right angles to the insertion direction.

11. A retrofit fluorescent lamp, comprising: an end piece, the end piece comprising:

a housing section open on a first end face and a cover that is configured to close off the first end face, wherein the housing section and the cover are configured to be non-detachably interlocked, wherein at least two projecting locking hooks are present on the first end face of the end piece and the cover has corresponding locking recesses.

12. The retrofit fluorescent lamp as claimed in claim 11, wherein the end piece accommodates a driver.

13. The retrofit fluorescent lamp as claimed in claim 11, wherein it has a hollow heat sink extending lengthwise along a longitudinal axis of the retrofit fluorescent lamp, wherein a shape of the inside contour of the heat sink essentially corresponds to the shape of the outside contour of the plug pin.

14. The retrofit fluorescent lamp as claimed in claim 11, wherein the heat sink has at least one screw hole which can be made to coincide with the screw bushing of the plug pin.

15. The retrofit fluorescent lamp as claimed in claim 11, wherein the retrofit fluorescent lamp is configured as a light emitting diode retrofit fluorescent lamp.

* * * * *